United States Patent [19]
Coe
[11] 4,413,944
[45] Nov. 8, 1983

[54] TRACTOR FRONT LOADER WITH LOCKING STRUT

[75] Inventor: Anthony D. Coe, Manchester, England

[73] Assignee: David Brown Tractors Ltd., Huddersfield, England

[21] Appl. No.: 240,058

[22] Filed: Mar. 3, 1981

[30] Foreign Application Priority Data

Mar. 14, 1980 [GB] United Kingdom ..... 8008806

[51] Int. Cl.[3] ..... B66C 23/36

[52] U.S. Cl. ..... 414/685; 414/680; 298/17 B; 92/18

[58] Field of Search ..... 414/685, 713, 680; 92/18; 172/466, 413; 187/8.47; 298/17 B; 37/103, 118 R, 117.5; 403/353

[56] References Cited

U.S. PATENT DOCUMENTS

| | | | |
|---|---|---|---|
| 547,221 | 10/1895 | Mann | 92/18 X |
| 743,508 | 11/1903 | Hornung | 92/18 X |
| 2,846,097 | 8/1958 | Beyerstedt | 414/713 |
| 3,021,908 | 2/1962 | Dlugosch | 172/466 |
| 3,157,435 | 11/1964 | Sherven | 298/17 B |
| 3,171,554 | 3/1965 | Griffith | 414/713 |
| 3,659,309 | 5/1972 | Besnard | 403/353 |
| 3,982,648 | 9/1976 | Luedtke et al. | 414/713 |
| 4,039,093 | 8/1977 | Schmitz, Jr. et al. | 414/680 |
| 4,043,253 | 8/1977 | Albright et al. | 414/713 X |

FOREIGN PATENT DOCUMENTS

| | | | |
|---|---|---|---|
| 1531063 | 8/1969 | Fed. Rep. of Germany | 414/723 |

*Primary Examiner*—Joseph E. Valenza
*Assistant Examiner*—Donald W. Underwood

[57] ABSTRACT

Tractor front loaders have sometimes been provided with struts enabling them to be locked in raised position. These struts have had to be moved bodily between operative and inoperative positions. To avoid the need for bodily movement, the struts are made telescopic and are pivotable on loader support frames fixed to opposite sides of the tractor. Loader booms, and the rams of ram-and-cylinder assemblies for pivoting the booms, are pivotable on the support frames in known manner. The struts comprise inner and outer channel sections and are pivotable between retracted inoperative positions in which they are secured to the support frames and extended operative positions in which they are secured in contact with the adjacent ends of the cylinders of the extended assemblies.

4 Claims, 4 Drawing Figures

TRACTOR FRONT LOADER WITH LOCKING STRUT

BACKGROUND OF INVENTION

This invention relates to a tractor front-end loader provided with at least one strut for locking the loader in raised position.

Such loaders are already known, but their locking struts have to be moved bodily between operative and inoperative positions. For example, in one such loader the two locking struts are stowed on top of the respective booms.

The object of the present invention is to provide a locking strut which is unobtrusively stowed and easily deployed without the need to move it bodily.

SUMMARY OF INVENTION

According to the invention, a tractor front-end loader has support frame means, two parallel interconnected booms pivotable on said means between lowered and raised positions, respective hydraulic ram-and-cylinder assemblies for pivoting said booms, and at least one telescopic locking strut pivotable on said means between a retracted inoperative position in which it is secured to said means and an extended operative position in which it locks said booms in raised position.

BRIEF DESCRIPTION OF DRAWINGS

A preferred embodiment of the invention will now be described, by way of example, with reference to the accompanying drawings of which.

DESCRIPTION OF PREFERRED EMBODIMENT

Figure 1:
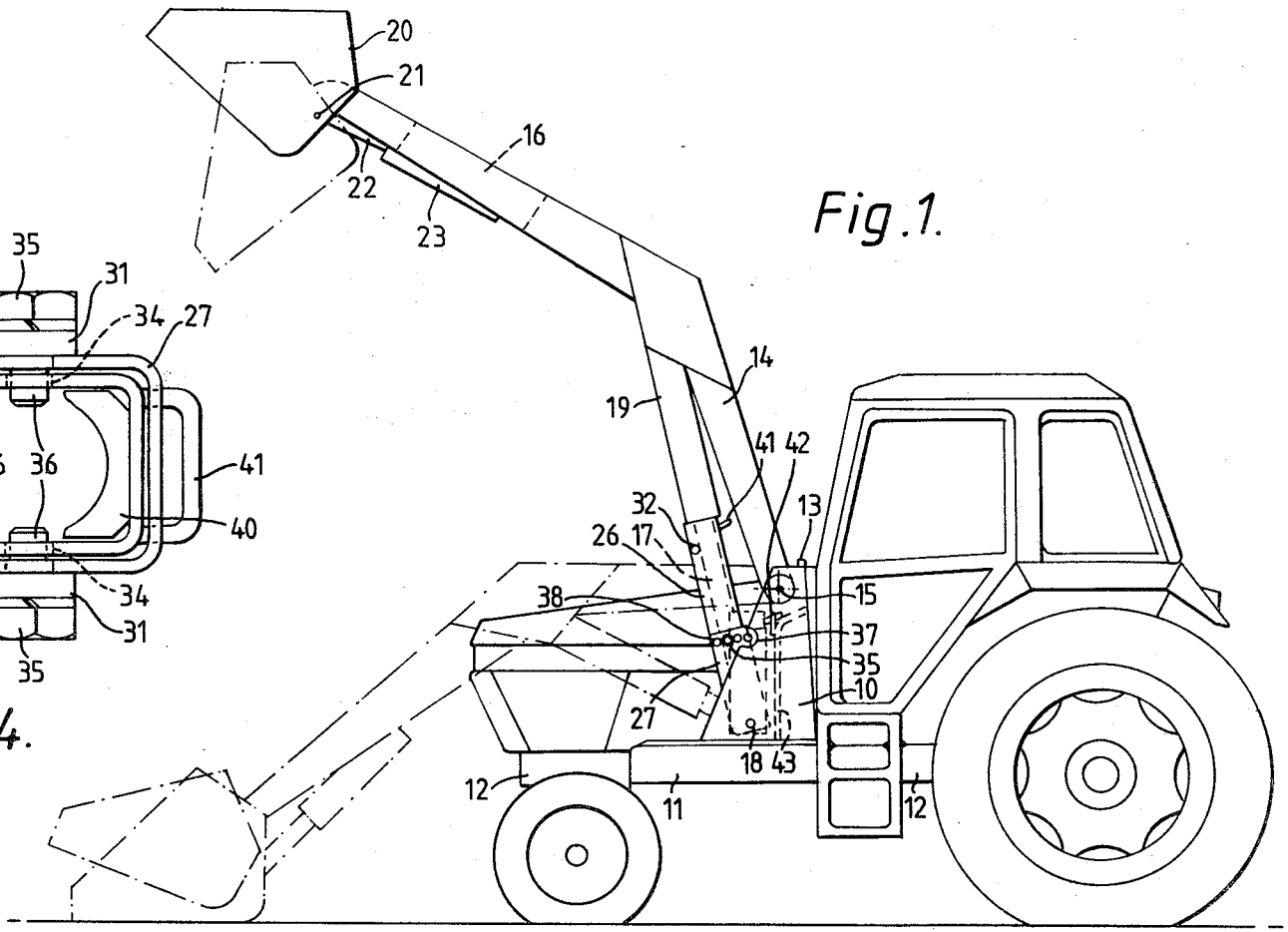
FIG. 1 is a semi-diagrammatic side elevation of a front-end loader mounted on a tractor and provided with telescopic locking struts, the loader being shown fully raised and the struts in extended operative position in full lines and the loader being shown lowered and the struts in retracted inoperative position in broken lines.
Figure 4:
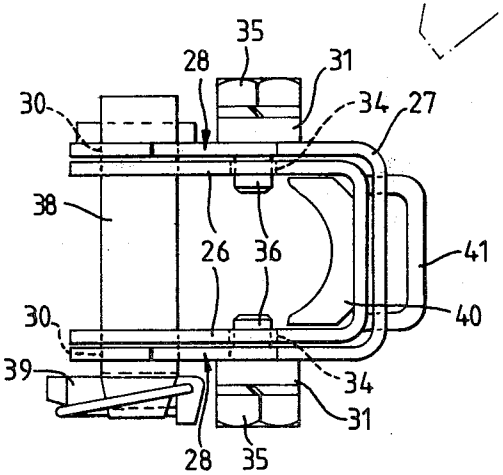
FIG. 4 is a view in the direction of the arrow 4 in FIG. 2.

Referring now to the drawings, a tractor front-end loader is provided with support frame means comprising two channel structures 10 which have their open edges facing forwards and in side elevation are right-angled triangles with their hypotenuses sloping downwardly and forwardly from their upper ends, which are truncated. Each of said structures has a stiffener plate 43 welded within it. The structures 10 are welded at their bases to respective angle-brackets 11 which are adapted to be semipermanently rigidly secured by means of set-screws to opposite sides of the main frame 12 of a tractor. The upper ends of the structures 10 are rigidly inter-connected by a cross-bar 13. Two loader booms 14 are mounted at their rear ends near the respective upper ends of the structures 10 so as to be pivotable about a common axis 15 disposed transversely of the tractor. The booms 14 are of shallow inverted V-shape in side elevation and parallel to one another in plan view, and are rigidly interconnected between their apices and their front ends by being bolted to opposite sides of a welded rectangular sub-frame 16. Two hydraulic ram-and-cylinder assemblies, which may be single- or double-acting, are provided for pivoting the booms 14 between lowered and raised positions. Each of said assemblies comprises a ram 17 connected by a pivot pin 18 within the lower part of one of the channel structures 10, and a cylinder 19 pivotally connected to the associated boom 14 near its apex. A loader bucket 20 or like attachment is mounted at the front ends of the booms 14 so as to be pivotable about an axis 21 disposed transversely of the tractor by means of a hydraulic ram-and-cylinder assembly disposed mid-way between the booms 14, the ram 22 of said assembly being pivotally connected to a point on the sub-frame 16 and the cylinder 23 thereof being pivotally connected to a suitably disposed point on the bucket 20.

Figure 2:
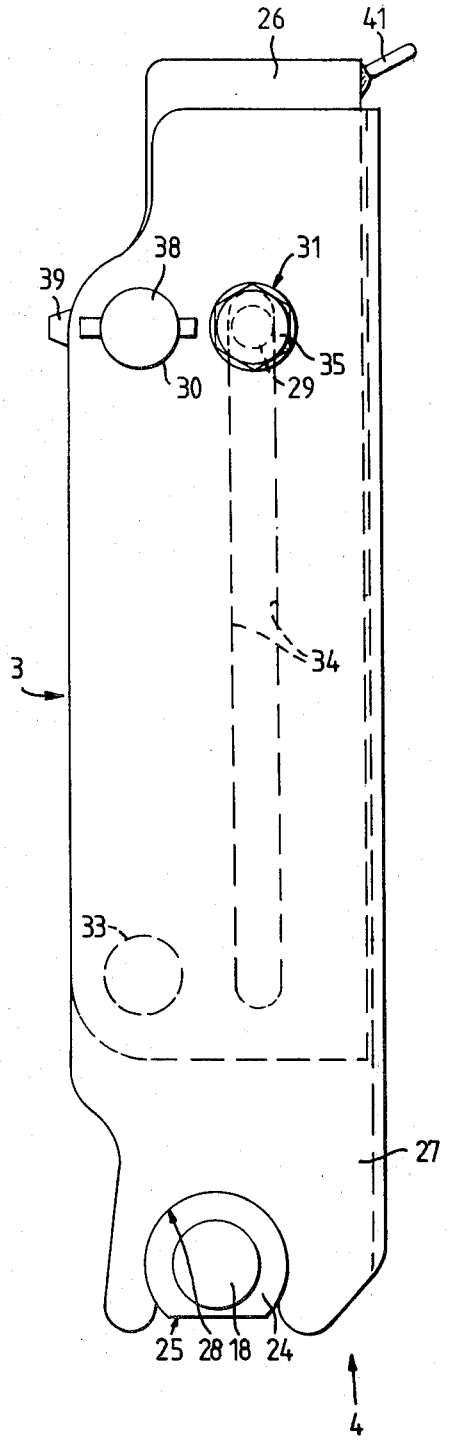
FIG. 2 is a side elevation on a larger scale of a strut in its retracted inoperative position.
Figure 3:
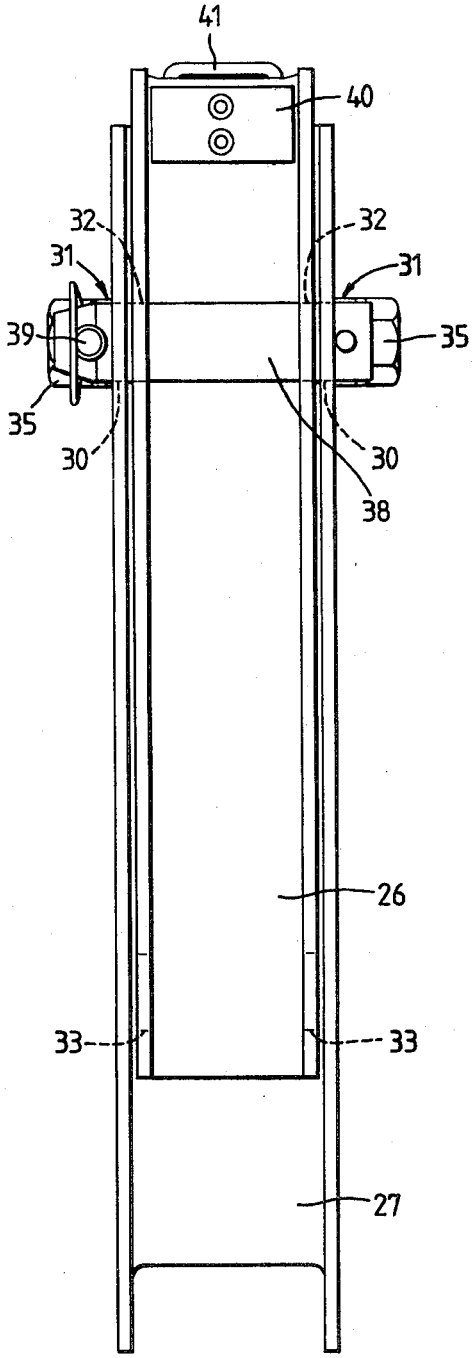
FIG. 3 is a view in the direction of the arrow 3 in FIG. 2.

The pivot pins 18 which connect the rams 17 of the first-mentioned ram-and-cylinder assemblies to the channel structures 10 are housed within aligned pairs of circular bosses 24 (see FIG. 2) on said structures, each boss 24 having a flat 25 on the underside of its periphery. Pivotally mounted on the bosses 24 are respective telescopic locking struts each comprising an inner channel member 26 and an outer channel member 27. In the side walls of the outer channel member 27 there are formed at its lower end a pair of aligned part-circular surfaces 28 which extend through an arc of more than 180° and co-operate with the associated bosses 24; and near its upper end two pairs 29 and 30 of aligned holes. Collars 31 are welded at the outer ends of the pair 29 of holes, and said collars and their associated holes are internally screw-threaded. In the side walls of the inner channel member 26 there are formed two pairs 32 and 33 of aligned holes, one pair near each end of said member; and a pair of aligned longitudinal slots 34 into which there extend, to form a pin-and-slot connection, spigots 36 on the ends of set-screws 35 engaged in the screw-threaded collars 31 and associated holes 29 of the outer channel member 27. Recesses 37 are formed in the front edges of the channel structures 10 to accommodate the collars 31 and the heads of the set-screws 35. A removeable pin 38 is passed through the pair 30 of holes in the outer channel member 27 and through either one or the other of the pairs 32 and 33 of aligned holes in the inner channel member 26 in order to hold the strut in either its retracted or extended positions, and the pin 38 is retained in its operative position by a linch pin 39. The inner channel member 26 also has rivetted inside its upper end a concave block 40 adapted to contact the associated ram 17, and welded to its upper end a U-shaped catch 41 adapted to engage a projection 42 welded to the associated stiffener plate 43.

In operation, the telescopic locking struts normally occupy their retracted inoperative positions shown in broken lines in FIG. 1 in which the removeable pins 38 pass through the pairs 30 of holes in the outer channel members 27 and the upper pairs 32 of holes in the inner channel members 26, the spigots 36 on the set-screws 35 are at the upper ends of the slots 34, and the catches 41 engage the projections 42. When it is desired to lock the loader booms 14 in raised position with the ram-and-cylinder assemblies connected to the channel structures 10 fully extended, the removeable pins 38 are withdrawn, the struts are extended until the spigots 36 on the set-screws 35 reach the lower ends of the slots 34 and are pivoted forwardly until they embrace the associated rams 17 and the concave blocks 40 contact said rams, the pins 38 are passed through the pairs 30 of holes in the outer channel members 27 and the lower pairs 33 of holes in the inner channel members 26 to hold the struts extended and to secure the struts to the rams 17, and the upper ends of the inner channel members 26 contact abutments constituted by the adjacent ends of the cylinders 19 of said assemblies, which are thereby prevented from retracting, as shown in full lines in FIG. 1. The struts are equally easily returned to their retracted inoperative positions by withdrawing the removeable pins 38, pivoting the struts rearwardly out of contact with the associated ram-and-cylinder assemblies and into a vertical position, retracting the struts until the spigots 36 on the set-screws 35 reach the upper ends of the slots 34 and the catches 41 re-engage the projections 42, and passing the pins 38 through the pairs 30 of holes in the outer channel members 27 and the upper pairs 32 of holes in the inner channel members 26. Each strut is removeable from the loader by first disconnecting the associated ram 17 from the associated channel structure 10 and then pivoting the strut forwardly to a substantially horizontal position in which its part-circular surfaces 28 are moveable radially away from the associated bosses 24 by virtue of the flats 25 on said bosses.

In a modification, on a single locking strut is provided, at one side of the loader. In another modification, the inner channel member is the lower one and the outer channel member is the upper one, the operative features of said members being appropriately re-arranged.

I claim:

1. A tractor front-end loader having support frame means comprising two channel structures adapted to be rigidly secured to opposite sides of the tractor, respective parallel interconnected booms pivotable on said structures between lowered and raised positions, respective hydraulic ram-and cylinder assemblies for pivoting said booms, and at least one telescopic locking strut comprising mutually slideable members which is housed partially within one of the channel structures and is pivotable thereon between a retracted inoperative position in which it is secured to said one structure and an extended operative position in which it locks said booms in raised position, wherein one of the mutually slideable members is pivotally mounted on said one structure by a part-circular surface formed at one end of said one member and extending through an arc of more than 180° which co-operates with a circular boss forming part of said one structure and provided with a flat on its periphery, said boss housing a pivot pin which connects the ram of the associated ram-and-cylinder assembly to said one structure and the arrangement being such that the telescopic locking strut is removable from the loader by first disconnecting said ram from said one structure and then pivoting said strut to an angular position in which said surface is moveable radially away from the boss by virtue of the flat on the boss.

2. A tractor front-end loader according to claim 1, wherein the mutually slideable members comprise inner and outer channel members, a fixed pin in a hole in either one of the channel members engaging in a slot in the other of the channel members for guiding relative sliding of the channel members of the telescopic locking strut between its operative and inoperative positions, and a removeable pin in a hole in either one of the channel members being engageable selectively in either of two holes in the other of the channel members for holding said strut in each of its operative and inoperative positions.

3. A tractor front-end loader according to claim 2, wherein the removeable pin also acts to secure the extended strut in operative position embracing the ram of the associated extended ram-and-cylinder assembly and in contact with the adjacent end of the cylinder thereof.

4. A tractor front-end loader according to claim 2 or claim 3, wherein the outer channel member is pivotally mounted on said one channel structure.

* * * * *